US009169744B2

(12) United States Patent
Schüle et al.

(10) Patent No.: US 9,169,744 B2
(45) Date of Patent: Oct. 27, 2015

(54) STEAM POWER PLANT WITH HEAT RESERVOIR AND METHOD FOR OPERATING A STEAM POWER PLANT

(76) Inventors: Volker Schüle, Leimen (DE); Ewald Kitzmann, Weinheim (DE); Matthias Legin, Frankenthal (DE)

( * ) Notice: Subject to any disclaimer, the term of this patent is extended or adjusted under 35 U.S.C. 154(b) by 870 days.

(21) Appl. No.: 12/951,639

(22) Filed: Nov. 22, 2010

(65) Prior Publication Data

US 2011/0131993 A1 Jun. 9, 2011

(30) Foreign Application Priority Data

Dec. 5, 2009 (EP) ..... 09015097

(51) Int. Cl.

| | |
|---|---|
| ***F01K 13/00*** | (2006.01) |
| ***F01K 3/00*** | (2006.01) |
| ***F01K 3/26*** | (2006.01) |
| ***F01K 7/40*** | (2006.01) |

(52) U.S. Cl.

CPC ..... *F01K 3/004* (2013.01); *F01K 3/265* (2013.01); *F01K 7/40* (2013.01)

(58) Field of Classification Search

USPC ..... 60/645–681

See application file for complete search history.

(56) References Cited

U.S. PATENT DOCUMENTS

| | | | | |
|---|---|---|---|---|
| 1,656,985 | A * | 1/1928 | Monroe | 60/678 |
| 1,680,752 | A * | 8/1928 | Stein | 60/662 |
| 1,897,815 | A * | 2/1933 | Osenberg | 60/659 |
| 2,900,793 | A * | 8/1959 | Burt | 60/667 |
| 3,289,408 | A * | 12/1966 | Silvestri, Jr. | 60/678 |
| 3,448,580 | A * | 6/1969 | Frederick | 60/652 |
| 3,886,749 | A * | 6/1975 | Pacault | 60/652 |
| 3,979,914 | A * | 9/1976 | Weber | 376/402 |
| 4,003,786 | A | 1/1977 | Cahn | |
| 4,043,130 | A * | 8/1977 | Brown et al. | 60/655 |
| 4,057,966 | A * | 11/1977 | Prutkovsky et al. | 60/678 |
| 4,069,674 | A * | 1/1978 | Warren | 60/641.8 |
| 4,129,004 | A * | 12/1978 | Thelen et al. | 60/652 |
| 4,130,992 | A * | 12/1978 | Bitterlich et al. | 60/652 |
| 4,164,848 | A | 8/1979 | Gilli et al. | |
| 4,428,190 | A * | 1/1984 | Bronicki | 60/655 |
| 5,699,666 | A * | 12/1997 | Kurten et al. | 60/652 |
| 6,076,355 | A * | 6/2000 | Ven et al. | 60/655 |
| 2011/0131993 | A1 * | 6/2011 | Schule et al. | 60/645 |

FOREIGN PATENT DOCUMENTS

| | | |
|---|---|---|
| DE | 1128437 | 4/1962 |
| GB | 899076 | 2/1962 |
| GB | 896194 A * | 5/1962 |

OTHER PUBLICATIONS

European Search Report dated Oct. 15, 2010.

* cited by examiner

*Primary Examiner* — Jesse Bogue
*Assistant Examiner* — Mickey France
(74) *Attorney, Agent, or Firm* — Robert D. Crawford

(57) ABSTRACT

A steam power plant is suggested having, parallel to the preheater passage (VW1 to VW4), a heat reservoir (25) which is loaded with preheated condensate in weak-load times. This preheated condensate is taken from the heat reservoir (25) for generating peak-load and inserted downstream of the preheater passage into the condensate line (19.2) resp. the feed water container (8). Thus it is possible to quickly control the power generation of the power plant in a wide range without significantly having to change the heating output of the boiler of the steam generator (1). A steam power plant equipped according to the invention can thus be operated with bigger load modifications and also provide more control energy.

20 Claims, 8 Drawing Sheets

STEAM POWER PLANT WITH HEAT RESERVOIR AND METHOD FOR OPERATING A STEAM POWER PLANT

BACKGROUND OF THE INVENTION

Conventional steam power plant plants have a closed water-steam cycle. In the steam generator so much energy is added to the boiler feed water by combustion of a fossil fuel that it passes into the vaporous aggregate condition. This steam drives a generator via one or several steam turbines and afterwards is liquefied again in one condenser.

As it is not possible to economically store electric energy in big scope, there were already considerations in the past aiming at storing thermal energy in a steam power plant in order to thereby increase the flexibility resp. adaption to net requirements (peak load).

It is known from U.S. Pat. No. 4,003,786 to arrange a chain of heat exchangers parallel to the preheater passage of the steam power plant. Via these heat exchangers it is possible to exchange heat between a part of the condensate stream and a thermo-oil. This means that the heat exchangers are streamed through by condensate on the one hand and a thermo-oil on the other hand. Thus it is possible to confer heat from the condensate to the thermo-oil in times of low demand and to store this heated thermo-oil. When subsequently a high output is requested, it is possible to re-confer the heat stored in the thermo-oil to the condensate via the same heat exchangers and thus to reduce the demand of tapping steam for preheating the condensate. Consequently, the output available at the generator is increased and the demanded peak load can be met in a better way.

This known arrangement is very complex and requires a multitude of heat exchangers as well as two heat reservoirs. For this reason two different heat reservoirs are required, because both heat reservoirs are operated at different temperatures, i.e. approximately 190° and 520° C.

It is the object of the invention to provide a steam power plant which can provide peak load stream and control energy, wherein the apparative effort required therefor is to be preferably low. Furthermore the strengthening of already existing steam power plants is to be possible in a preferably simple manner and with small manipulations of the steam power plant process.

DISCLOSURE OF THE INVENTION

According to the invention this object is solved by means of a steam power plant comprising a steam generator, a turbine, a condenser, a condensate line and at least one preheater and a heat reservoir, wherein the condensate line connects the condenser, the at least one preheater and a feed water container with each other and wherein the heat reservoir is arranged parallel to the at least one preheater and the heat reservoir is loaded with condensate which was preheated by at least one preheater.

Thus it is possible to branch off condensate to some extent and to temporarily store it in the heat reservoir in the weak load times so that the output of the steam generator can be maintained, even if the generated electric output of the power plant is considerably reduced. In these weak load times it is easily possible to branch off much tapping steam from the steam turbine and to preheat more condensate as is actually required.

This preheated condensate is temporarily stored in a heat reservoir according to the invention, wherein the heat reservoir is arranged parallel to one or several preheaters, preferably one or several low-pressure preheaters.

When the load now increases considerably, then it is possible to convey the condensate stored in the heat reservoir and being already preheated directly into the feed water container under circumvention of the preheaters. This means that only a very small condensate stream streams through the preheaters and consequently the steam quantity which has to be branched off from the turbines in order to preheat the condensate in the preheaters is reduced correspondingly. All the same the condensate stream streaming into the feed water container is maintained corresponding to the present load. Consequently after a shortest time more electric output is at disposal.

As with the steam power plant according to the invention the sensitive heat remains in the condensate and the condensate is temporarily stored in the heat reservoir, the apparative effort is low and the heat losses caused by the temporary storage of the condensate are also very low.

A further advantage of the steam power plant according to the invention is to be seen in that it is also possible to provide control energy by means of the heat reservoir, i.e. by either storing heat in the heat reservoir at short notice corresponding to the present demand or taking it therefrom.

A further advantage is to be seen in that the steam generator can be operated on a higher partial load level in weak load times and thus with an improved degree of efficiency.

A further very important advantage is to be seen in that even already existing steam power plants can generally be strengthened into a steam power plant according to the invention by integrating a heat reservoir, so that the advantages according to the invention can also be realized in already existing installations. Due to the simple apparative construction it is in fact also practically possible to retrofit already existing steam power plants.

In further advantageous embodiment of the invention it is provided that a "cold" connection of the heat reservoir is connected with a section of the condensate line extending upstream of the at least one preheater.

In an analogue manner a "warm" connection of the heat reservoir is connected with a section of the condensate line extending downstream of the at least one preheater.

As a connection of the heat reservoir, i.e. the cold connection, is connected with the condensate line upstream of the preheater(s) and the "warm" connection of the heat reservoir is connected with the section of the condensate line extending downstream of the preheater(s), the cold resp. warm condensate can easily be branched off from the condensate line resp. re-fed at the suitable place. It is also possible, according to the requirement profile of the heat reservoirs, to alternatively optimally control the temperature level of the tapping steam parallel to a preheater, two preheaters or several preheaters corresponding to the disposability at the turbine.

The connection of the heat reservoir according to the invention preferably takes place via a connecting line, wherein in a first section of the connecting line a pump, preferably a speed-regulated, pump is provided. Alternatively or additionally also in the second section of the connecting line a pump, preferably a speed-regulated pump, can be provided. However, use of pumps can/must not be necessary. Pumps can generally be necessary when discharging (hot/cold) the stored condensate in order to convey against existing system pressure. The furnishing of the heat reservoirs takes place via a bypass arranged control valves. The conveyance takes place via existing main condensate pumps.

By means of the at least one pump and the at least one control valve it is possible to exactly control the condensate stream which is branched off from the main condensate line and conveyed into the heat reservoir resp. the quantity of the condensate stream re-fed into the condensate line from the heat reservoir and thus achieve an optimal controllability of the power plant according to the invention. Usually the first section of the connecting line, which connects the condensate line with the cold connection of the heat reservoir, and the second section of the connection line, which connects the warm connection of the heat reservoir with the condensate line, will be constructed symmetrically. Of course non-return valves, shutoff devices etc. can be provided when required and in dependence.

Of course it is also possible, to some extent as emergency option, to provide a choke valve parallel to the control valve, so that in case of breakdown or maintenance of the control valve or in case of breakdown of the control valve the operation of the power plant, even with somewhat reduced control quality, can continue without disturbances.

Basically it is possible to construct the pressure reservoir in such a way concerning its pressure resistance that it withstands the pressure given in the condensate lines. Such a reservoir is usually constructed as mere displacement reservoir being 100% filled with condensate. However, from an operational point of view this often is not optimal. For this reason, a heat reservoir being filled with condensate up to only approximately 90% can be used. The remaining 10% are filled up by means of a steam bolster. Wherein control and choke valves have the task of maintaining the mass streams simultaneously supplied and discharged, overlapped by the heat reservoir level to be maintained.

In further advantageous embodiment of the invention it is provided that the steam power plant has several preheaters being connected in series, especially several low-pressure preheaters, and that the heat reservoir is arranged resp. connected parallel to the one or several of the preheaters. By means of the flexible connection of the heat reservoir either parallel to one, two or a different number of preheaters, the storage capacity of the heat reservoir can be adapted to the requirements and systematically more or less tapping steam from the high-pressure part, the medium-pressure part resp. the low-pressure part of the steam turbine can be provided for preheating the condensate. Thus a further degree of freedom for optimizing the operation of the steam power plant is given.

The above-mentioned object is also solved by a method for operating a steam power plant according to independent claim 9. Wherein the advantages according to the invention, as explained in connection with claims 1 to 8, are realized.

Further advantages and advantageous embodiments of the invention can be taken from the following drawing, its specification and the patent claims. All features described in the drawing, its specification and the patent claims can be relevant for the invention either taken by themselves or in optional combination with each other.

BRIEF DESCRIPTION OF THE DRAWINGS

Shown are.

DETAILED DESCRIPTION OF PREFERRED EMBODIMENTS

Figure 1:
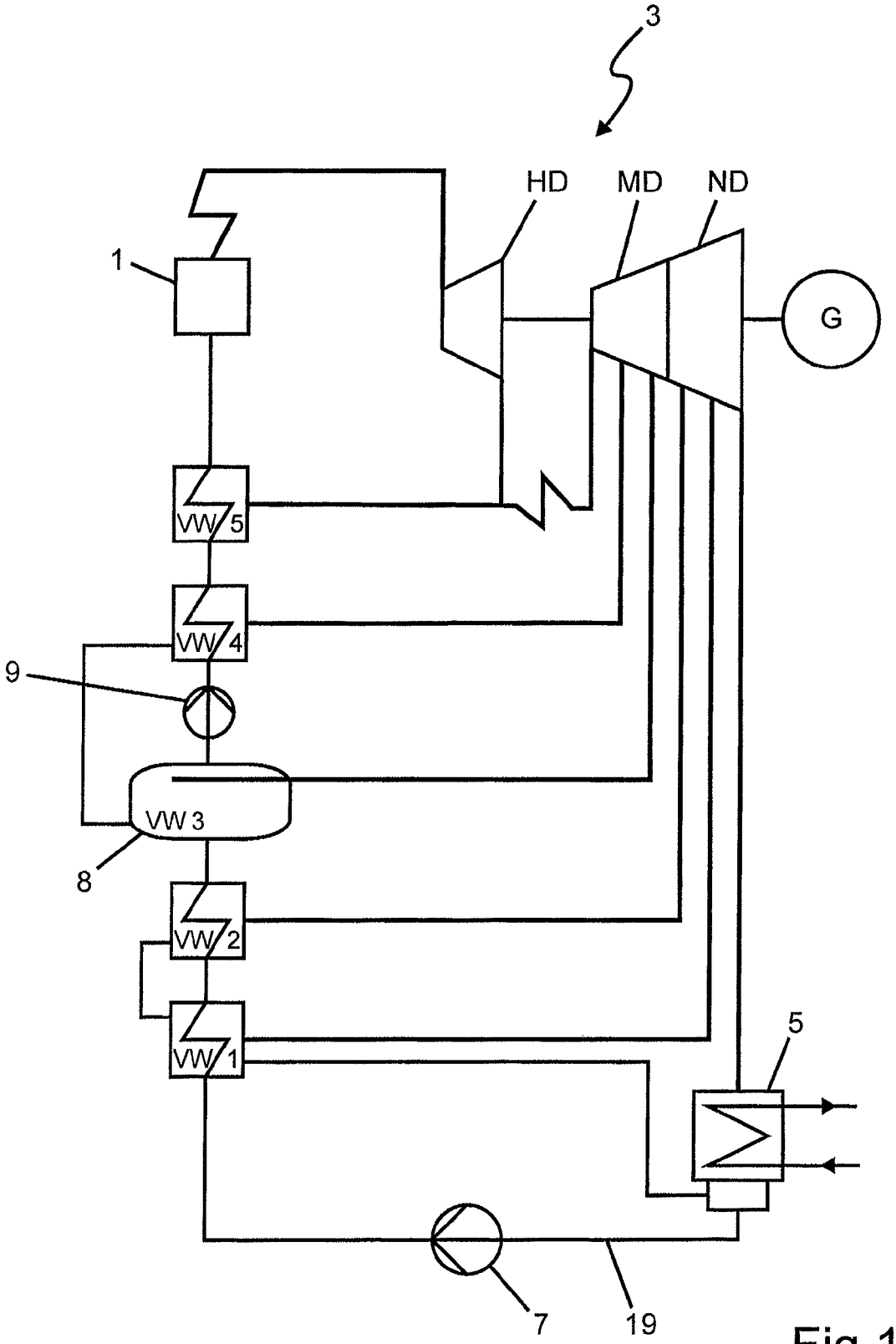
FIG. 1 A diagram of a conventional steam power plant.

In FIG. 1 a steam power plant fuelled with fossils or biomass is represented as block diagram. FIG. 1 essentially has the purpose of designating the single components of the power plant and to represent the water-steam-cycle in its entirety. For reasons of clarity in the following figures only those parts of the water-steam-cycle are represented which are essential to the invention.

In a steam generator 1 under utilization of fossil fuels or by means of biomass out of the feed water live steam is generated, which is expanded in a steam turbine 3 and thus drives a generator G. Turbine 3 can be separated into a high-pressure part HD, a medium-pressure part MD and a low-pressure part ND.

After expanding the steam in turbine 3, it streams into a condenser 5 and is liquefied there. For this purpose a generally liquid cooling medium, as e. g. cooling water, is supplied to condenser 5. This cooling water is then cooled in a cooling tower (not shown) or by a river in the vicinity of the power plant (not shown), before it enters into condenser 5.

The condensate originated in condenser 5 is then supplied, by a condensate pump 7, to several preheaters $VW_i$, with i=1 . . . n. In the shown embodiment behind the second preheater VW2 a feed water container 8 is arranged. Behind the feed water container 8 a feed water pump 9 is provided.

In combination with the invention it is of significance that the condensate from condenser 5 is preheated with steam beginning with the first preheater VW1 until the last preheater VW5. This so-called tapping steam is taken from turbine 3 and leads to a diminution of the output of turbine 3. With the heat exchange between tapping steam and condensate the temperature of the condensate increases from preheater to preheater. Consequently the temperature as well of the steam utilized for preheating must increase from preheater to preheater.

In the shown embodiment the preheaters VW1 and VW2 are heated with steam from low-pressure part ND of steam turbine 3, whereas the last preheater VW5 is partially heated with steam from high-pressure part HD of steam turbine 3. The third preheater VW3 arranged in the feed water container 8 is heated with steam from medium-pressure part MD of turbine 3.

Figure 2:
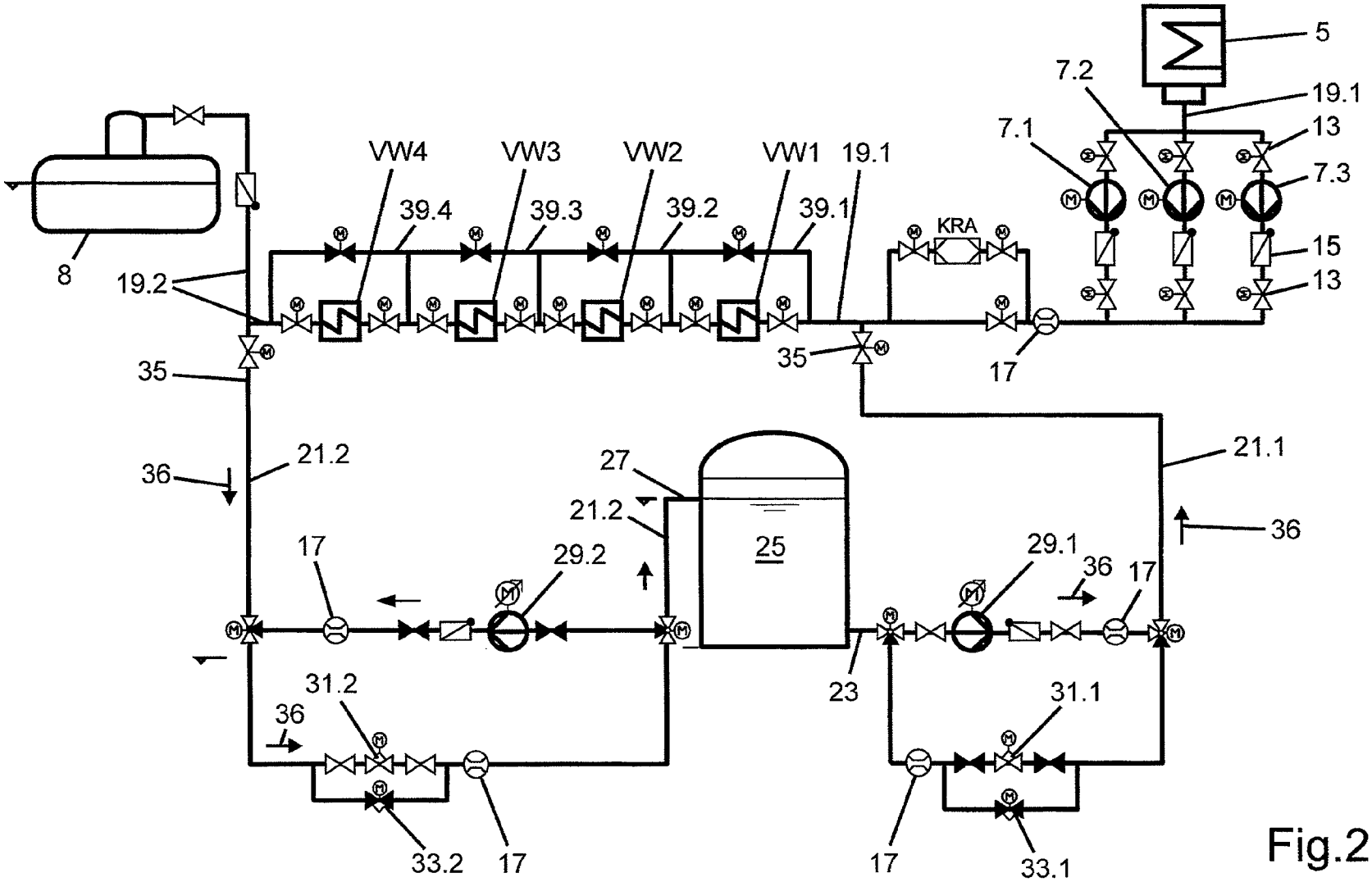
FIGS. 2 to 8 embodiments of steam power plants according to the invention.
Figure 3:
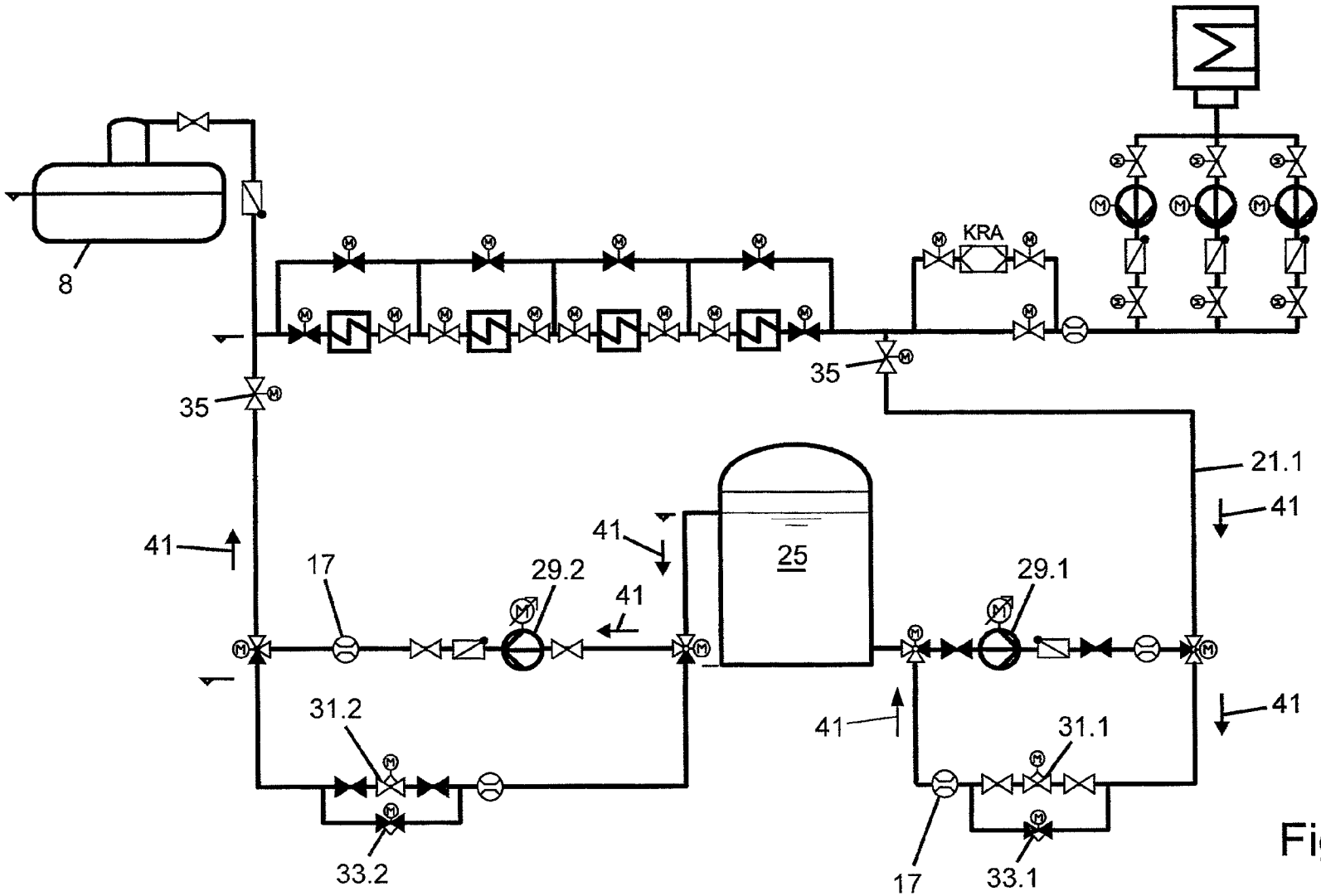

In FIGS. 2 and 3 various operation conditions of a first embodiment of a steam power plant according to the invention are shown. As the invention essentially is concerned with the section of the steam power plant between condenser 5 and feed water container 8, only this part of the steam power plant is shown in FIG. 2. Neither are, for reasons of clarity, all fittings and components in FIG. 2. designated with reference numerals. The designation of the fittings and representation of the fittings and components corresponds to DIN 2482 "Graphic symbols for heat diagrams", which herewith is referred to, and are thus self-explanatory. Where obviously identical connections are present several times, partially the insertion of reference numerals is dispensed with in order to maintain the clarity of the figures. As example thereof the strands of the three condensate pumps 7.1, 7.2 and 7.3 are designated. For reasons of clarity in the strand of the third condensate pump 7.3 only shutoff devices 13 and non-return valve 15 are provided with reference numerals.

Concerning the parts of the steam power process that are not represented FIG. 1 is referred to. Identical components are designated with identical reference numerals and what is mentioned concerning the other figures correspondingly applies.

In a first section 19.1 of the condensate line three condensate pumps 7.1, 7.2 and 7.3 are arranged. As several condensate pumps 7 are provided, the supply quantity can be simply controlled and in case of breakdown of one condensate pump the operation of the steam power plant is not impaired. The condensate pumps 7.1 to 7.3 are secured by means of shutoff devices 13 and non-return valves 15 and can be shut off if necessary.

Downstream of the condensate pumps 7.1 to 7.3 a flow-through measurement 17 and a condensate cleaning installation KRA are provided. Downstream of the condensate cleaning installation KRA a first section 21.1 of a connecting line 21 branches off. The first section 21.1 of the connecting line 21 is connected with a cold connection 23 of a heat reservoir 25. A second section 21.2 of the connecting line connects a warm connection 27 of heat reservoir 25 with a second section 19.2 of condensate line 19. The second section 19.2 of the condensate line is arranged downstream of preheater VW and upstream of feed water container 8. In the first section 19.1 as well as in the second section 19.2 of the condensate line liquid condensate flows.

Parallel to the control valves 31.1 and 31.3 choke valves 33.1 and 33.2 are provided which take over the tasks of control valves 31 in case of their breakdown.

All in all this guarantees a very high disposability and operation security of the power plant according to the invention. This is also achieved by realizing an identical construction at the cold and the warm side of heat reservoir 25 containing multiple redundancies. The redundancies can affect pumps 29 as well as control valves 31 and choke valves 33.

In the embodiment shown in FIG. 2 heat reservoir 25 is filled with liquid condensate up to approximately 90%. A small steam bolster is situated in the upper part of heat reservoir 25.

In FIG. 2 the condition is shown in which heat reservoir 25 is loaded. This means that pump 29.1 sucks condensate out of heat reservoir 25 and conveys it in the direction of arrows 36 and into the first section 19.1 of condensate line 19, i.e. upstream of the preheater passage, into condensate line 19.

Control valve 31.2 takes care that the filling level of heat reservoir 25 remains constant. Choke valve 33.2 is closed.

The shown shutoff devices 35 are necessary in order to separate the heat reservoir installation from the main condensate system in case of improper operation resp. excess of a defined container level.

When loading heat reservoir 25 cold condensate from heat reservoir 25 gets into condensate line 19.1 and is then preheated in preheater passage VW1 to VW4 as well as the condensate sucked out of condenser 5 by condensate pumps 7. With the condensate stream through the preheater passage of course the demand of tapping steam increases, so that the electric output of steam turbine 3 (cf. FIG. 1) is reduced correspondingly. I. e. that by means of loading heat reservoir 25 the electric output of the steam power plant can systematically and very quickly be reduced, without restricting the output of the steam generator.

As heat reservoir 25 when being loaded with preheated condensate is filled out of the second section 19.2 of the condensate line, the temperature of the condensate in heat reservoir 25 increases; i.e. sensitive heat is stored in heat reservoir 25.

When loading heat reservoir 25 pump 29.1 is in operation. The shutoff devices before and behind pump 29.1 are opened. Choke valves 33.1 and 33.2, pump 29.2 and shutoff devices of pump 29.2 are closed. Control valve 31.2 is in engagement. Consequently the condensate stream taken from the heat reservoir exclusively streams via pump 29.1 and flow-through measurement 17.

In FIG. 3 the unloading process of the embodiment according to FIG. 2 is shown. Consequently the stream direction of the condensate into the first connecting line 21.1 and 21.2 reverses against the loading process shown in FIG. 2. This is demonstrated by arrows 41.

In the other embodiments as well (FIG. 4) arrows 36 show the stream direction of the condensate during the loading and arrows 41 the stream direction of the condensate during the unloading of heat reservoir 25.

When loading pump 29.1 is set into operation and pump 29.2 is set out of operation. When unloading heat reservoir 25 pump 29.2 is in operation.

With the embodiment of the steam power plant according to the invention explained by means of FIGS. 2 and 3 the first section 21.1 of the connecting line always branches off before first preheater VW1 and the second section of connecting line 21.2 always ends upstream of last preheater VW4 into condensate line 19. Thus must not necessarily always be the case; by this connection a maximal additional output is provided.

Between condensate line 19 and heat reservoir 25 shutoff devices 35 are arranged. With the utilization of a heat reservoir being filled with condensate only up to 90% and with a steam bolster up to 10%, a lower operation pressure in the heat reservoir occurs than in condensate line 19, which has the result of a cost-saving construction.

Figure 4:
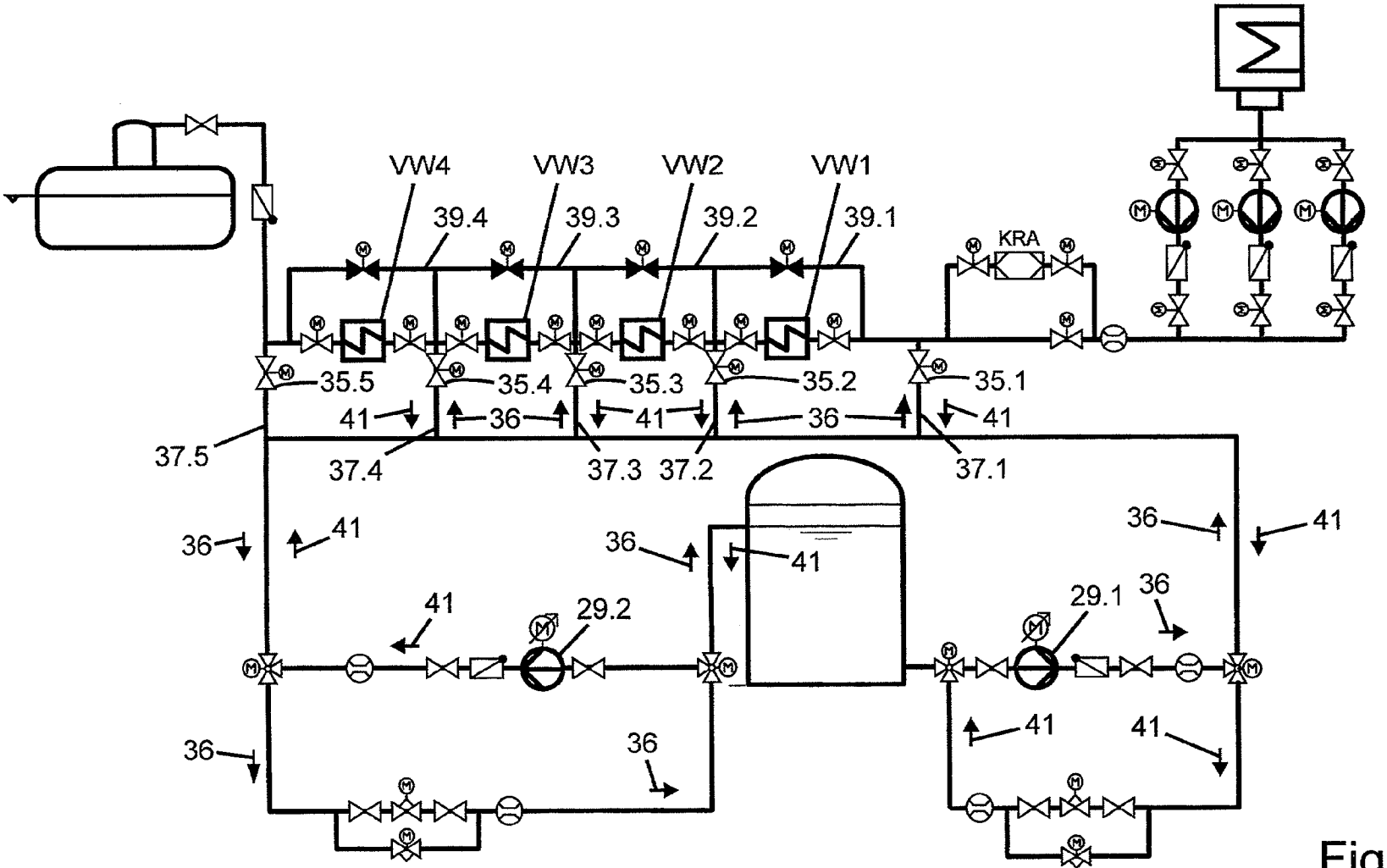

In FIG. 4 a second embodiment of a steam power plant according to the invention is shown, with which taking out and feeding-in of condensate of condensate line 19 can take place in a flexible manner. For this purpose five shutoff devices 35.1 to 35.5 and four branch lines 37.1 to 37.4 are provided altogether.

The first branch line 37.1 branches off from condensate line 19 between condensate cleaning installation KRA and the first preheater VW1. The second branch line 37.2 is arranged between the first preheater VW1 and the second preheater VW2. The third branch line 37.3 is arranged between the second preheater VW2 and the third preheater VW3. The same applies to the fourth branch line 37.4.

In each of these branch lines 37.1 to 37.4 a shutoff device 35.1 to 35.5 is provided. Furthermore, parallel to each preheater VW1 to VW4, a bypass-line 39.1 to 39.4 with a shutoff device (without reference numeral) is provided.

With branch lines 37 it is possible, according to requirements, to connect heat reservoir 25 parallel e.g. only to the first preheater VW1. This means that in heat reservoir 25, due to the comparatively small temperature difference between the cold condensate and the condensate preheated solely by the first preheater VW1, only relatively little energy is stored with a low temperature level.

Alternatively it is also possible to connect preheater 25 parallel to preheater VW4 and thus operate it on a temperature level corresponding to the temperature level of preheater VW4. Of course it is also possible to connect heat reservoir 25 parallel to the preheaters VW2 and VW3. Depending on the requirements concerning the operation of the steam power plant all combinations of parallel connection of heat reservoir 25 to one or several preheaters VW1 are possible. This variation of the steam power plant according to the invention thus allows a very flexible and thus economical and thermodynamically optimal operation of the steam power plant. The stream directions of the condensate during loading and unloading heat reservoir 25 are illustrated by arrows 36 and 41.

With the embodiment according to FIG. 4 as well the level regulation in heat reservoir 25 takes place via control valves 31.1/31.2.

Figure 5:
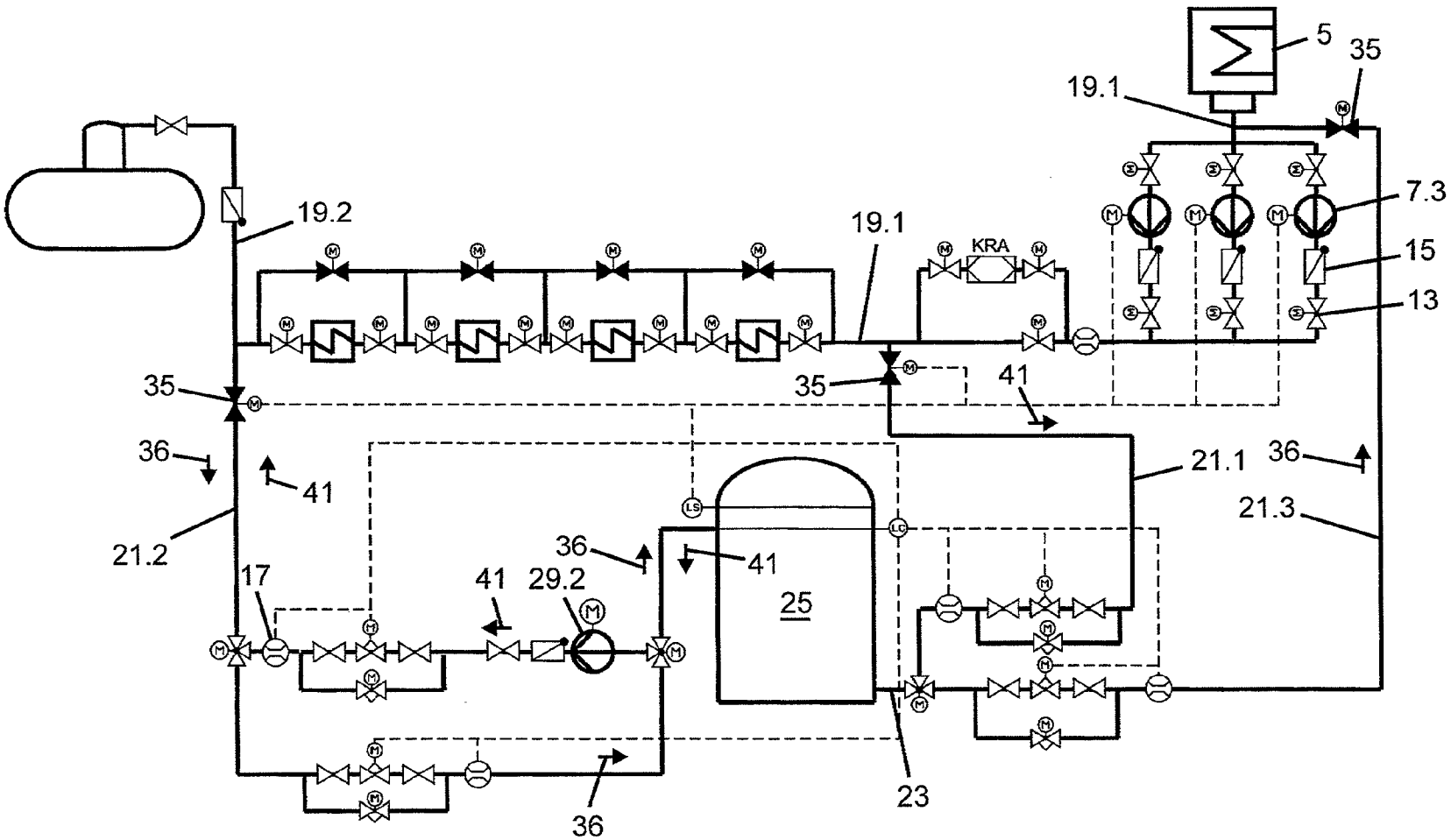

In FIG. 5 a further embodiment of the steam power plant according to the invention is shown. With this connection variation heat reservoir 25 with its cold connection 23 is connected twice with the first section 19.1 of the condensate line. Section 21.1 of the connecting line is already known from the preceding embodiments. A third section 21.3 branches off from condensate line 19.2 between condenser 5, to be more precise from Hotwell, and before condensate pumps 7 and ends in the cold connection 23 of heat reservoir 25.

As the pressure in condensate line 19.1 upstream of condensate pumps 7 is very small, it is possible to load the heat reservoir without pump 29. The pressure difference between second section 19.2 and the exit of condenser 5 is sufficient for this purpose.

When unloading heat reservoir 25 during operation of pump 29.2 the condensate can be extracted via the cold connection 23 and the first section 21.1 of connecting line 21 and fed-in by control valve 31.1 into heat reservoir 25. When heat reservoir 25 is unloaded the third section 21.3 of connecting line 21 is closed and loading takes place via the first section 21.1 of the connecting line and a corresponding control of control valve 33.1. In this case condensate pumps 7 take over the pressure increase of the condensate required for loading, because contrary to the aforementioned embodiments a pump 29.1 is not provided.

Figure 6:
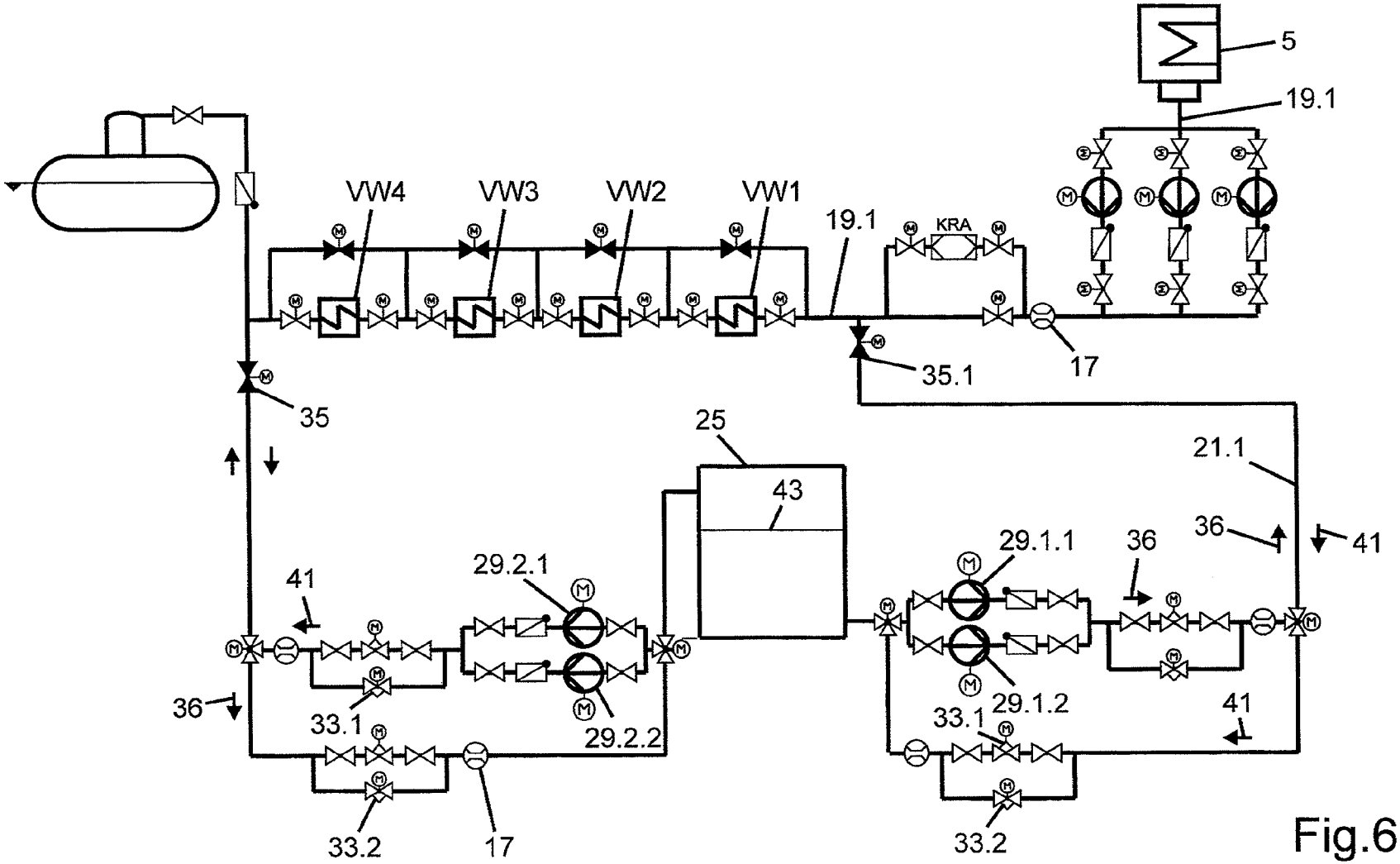

With the embodiment according to FIG. 6 heat reservoir 25 is constructed as displacement reservoir. That means that it is completely filled with liquid condensate. The separation line between cold condensate in the lower part of heat reservoir 25 and the preheated condensate in the upper part of heat reservoir 25 is indicated by a horizontal line 43 in FIG. 6.

With the embodiment according to FIG. 6 all pumps can be constructed redundantly. Of course this is also possible with the other embodiments. All pumps 29 have the common feature that they can dispose of a speed control so that an optimal and at the same time energy saving operation of pump 29 is possible.

Figure 7:
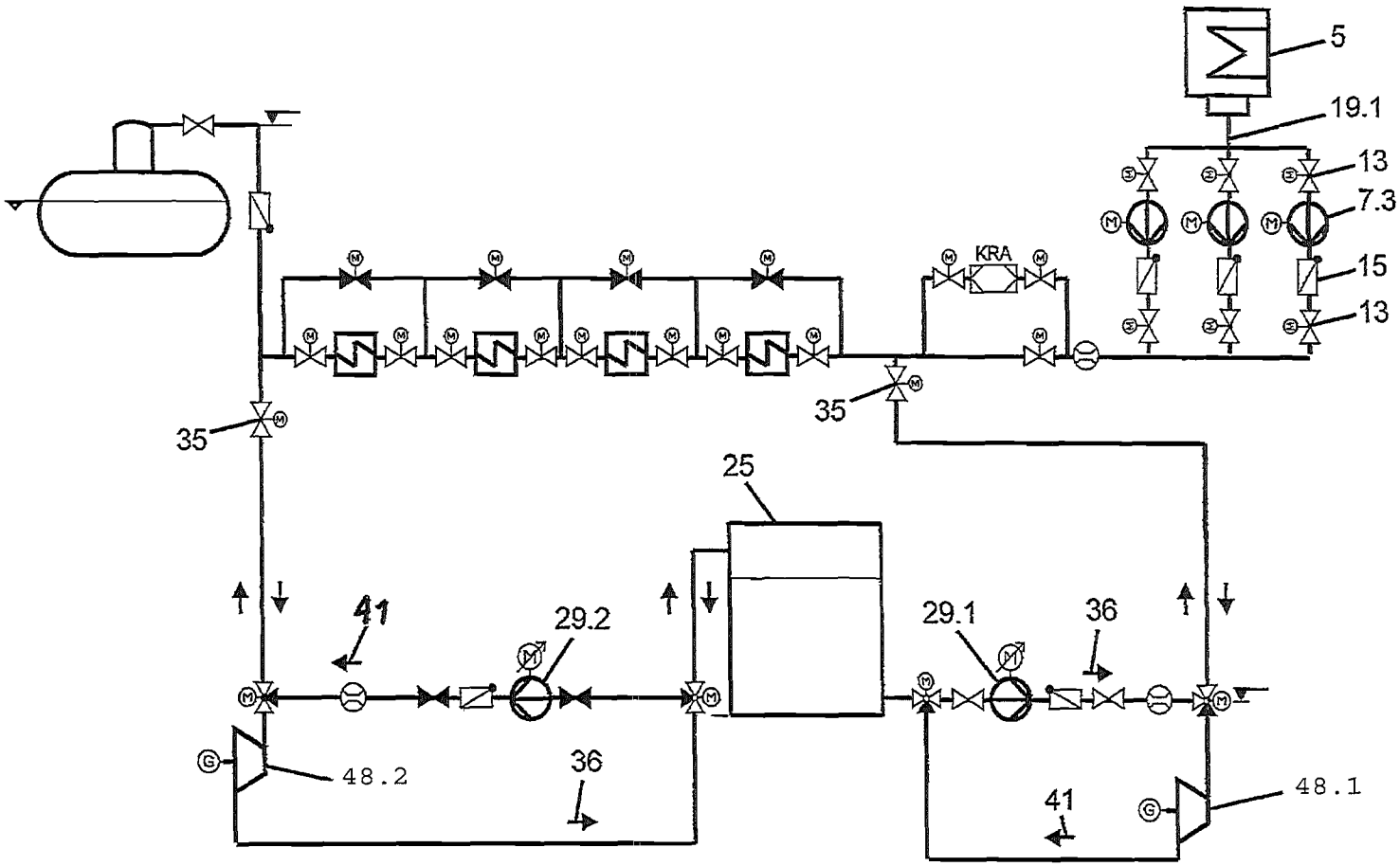

With the embodiment according to FIG. 7 an energy recycling takes place via turbines 48 converting the pressure energy into mechanical energy. The mechanical energy generated in the turbines 48 is converted into electric energy by a generator. In this way the own requirements of the steam power plant according to the invention are reduced. Furthermore pipelines are uncritical concerning their effects on the operation of the steam power plant in case of breakdown. If, e.g. the generator of turbine 48 is separated from the net, pipelines 31 also throttle in case of runaway speed and thus reduce the pressure. The same applies to a blocked bulb turbine resp. a blocked generator. For this reason these turbines are no additional shutoff organs or redundant components.

Figure 8:
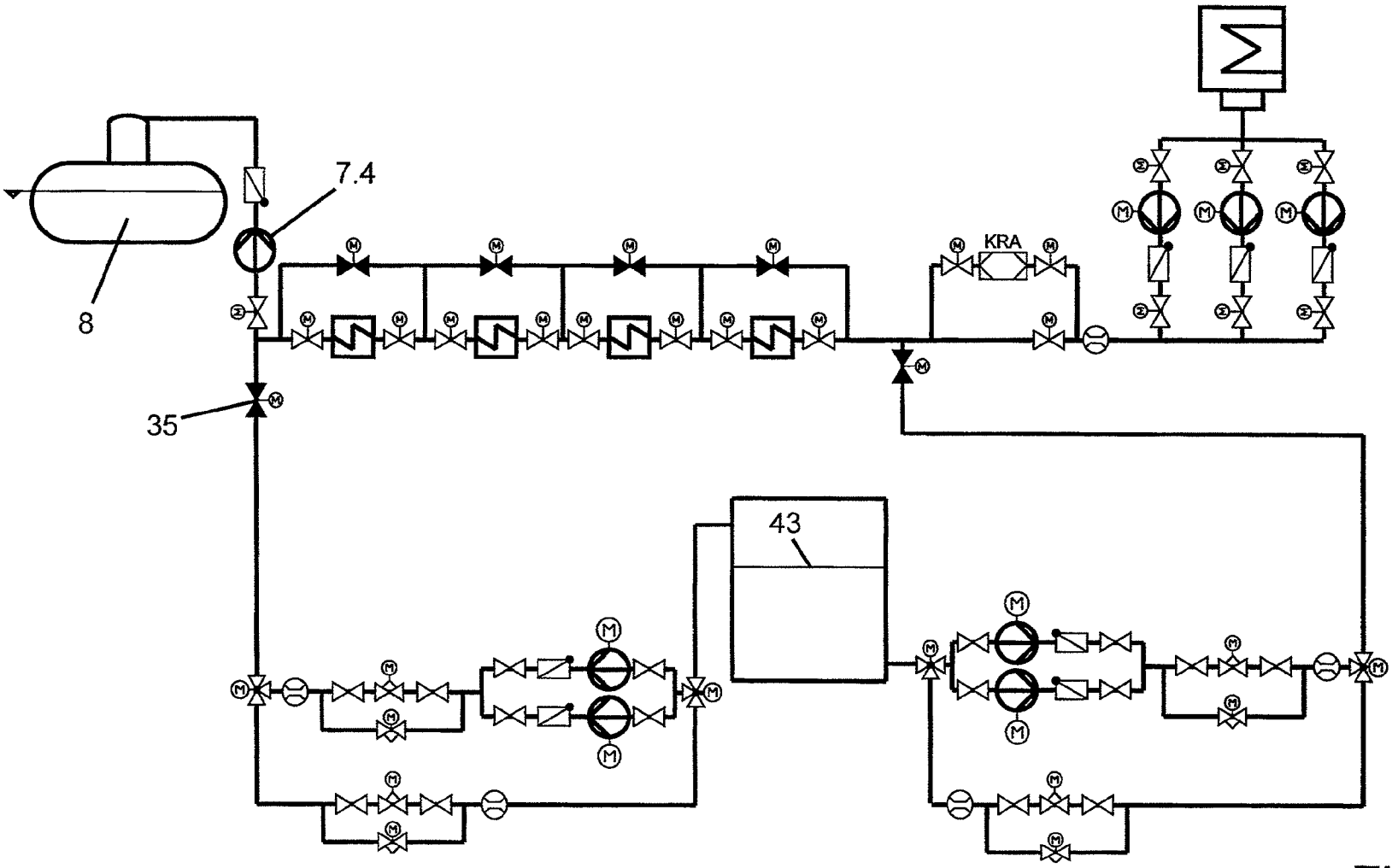

The embodiment according to FIG. 8 shows large analogies to the embodiment according to FIG. 6. However, and this is the essential difference, in the second section 19.2 of the condensate line, i.e., a fourth condensate pump 7.4 is provided serving as a pressure increase of the condensate before it streams into feed water container 8. Thus it is possible to correspondingly lower the pressure level in condensate line 19 as well as in connecting line 21 and heat reservoir 25. Thereby a very simple and safe system is provided which additionally has a low own-current demand.

With the embodiment according to FIG. 8 the pressure level in the preheaters VW and in heat reservoir 25 can be clearly reduced compared to the aforementioned embodiments, as between preheater passage and feed water container 8 a fourth condensate pump 7.4 is provided, which brings the condensate provided in the second section 19.2 to the required pressure level and conveys it into feed water boiler 8. Otherwise this embodiment essentially corresponds to the embodiment shown in FIG. 6.

The invention claimed is:

1. A steam power plant comprising:

a steam generator;

a turbine that expands steam provided by the steam generator;

a condenser that condenses expanded steam received from the turbine to provide a condensate;

a condensate line that receives the condensate;

a condensate pump disposed downstream of the condenser to pass the condensate through the condensate line;

at least one preheater disposed downstream of the condensate pump to heat the condensate passing through the condensate line;

a feed water container disposed downstream of the at least one preheater to receive the condensate from the at least one preheater via the condensate line; and a heat reservoir having a cold connection and a warm connection and fluidly coupled in parallel to the at least one preheater;

a connecting line fluidly coupling the heat reservoir to the condensate line;

wherein the connecting line includes a first section and a second section, the first section fluidly coupling the warm connection to the condensate line between the at least one preheater and the feed water reservoir the second section fluidly coupling the cold connection to the condensate line between the condensate pump and the at least one preheater;

a first section pump disposed in the first section of the connecting line arranged to provide condensate from the heat reservoir to the condensate line;

a second section pump disposed in the second section of the condensate line arranged to provide condensate from the heat reservoir to the condensate line;

a first section bypass line fluidly coupled in parallel to the first section of the connecting line to provide condensate preheated by the at least one preheater to the heat reservoir; and a second section bypass line fluidly coupled in parallel to the second section of the connecting line to provide condensate from the connecting line to the heat reservoir.

2. The steam power plant according to claim 1, further comprising a first control valve disposed in the first section bypass line and a second control valve in the second section bypass line.

3. The steam power plant according to claim 1, wherein between the condensate line and the heat reservoir a means for level-regulation in the heat reservoir is provided.

4. The steam power plant according to claim 1, further comprising a first choke valve disposed in the first section bypass line and a second choke valve disposed in the second section bypass line.

5. The steam power plant according to claim 1, further comprising a first expansion turbine in the first section bypass line and a second expansion turbine disposed in the second section bypass line.

6. The steam power plant according to claim 1, wherein the at least one preheater is at least one low pressure preheater.

7. The steam power plant according to claim 1, wherein the at least one preheater is a plurality of preheaters.

8. The steam power plant according to claim 1, further comprising at least one other preheater disposed downstream of the at least one preheater wherein the first section of the connecting liner fluidly connects to the condensate line between the at least one preheater and the at least one other preheater.

9. The steam power plant according to claim 1, further comprising at least one other preheater disposed upstream of the at least one preheater wherein the second section of the connecting liner fluidly connects to the condensate line between the at least one preheater and the at least one other preheater.

10. A method for operating a steam power plant having a steam generator, a turbine, a condenser, at least one preheater, a feed water container, and a heat reservoir; the method comprising:

connecting the condenser, the at least one preheater and the feed water container with a condensate line, with the at least one preheater positioned between the condenser and the feed water container;

connecting a heat reservoir parallel to the at least one preheater with a connecting line;

preheating condensate with the at least one preheater; and loading the heat reservoir with the preheated condensate;

wherein along the connecting line a cold connection of the heat reservoir is connected with a section of the condensate line extending upstream of the at least one preheater, and a warm connection of the heat reservoir is connected with a section of the condensate line extending downstream of the at least one preheater; and wherein the at least one preheater is a low-pressure preheater.

11. The method according to claim 10, further comprising:

unloading the heat reservoir by conveying the condensate stored in the heat reservoir downstream of the at least preheater into the condensate line.

12. The method according to claim 10, further comprising:

increasing the pressure of the condensate streaming out of the heat reservoir into the condensate line.

13. The method according to claim 10, further comprising:

pumping the condensate stored in the heat reservoir into the condensate line downstream of the at least one preheater while supplying condensate from the condensate line upstream of the at least one preheater to the heat reservoir.

14. The method according to claim 10, further comprising:

pumping the condensate stored in the heat reservoir into the condensate line upstream of the at least preheater while loading the heat reservoir with the preheated condensate.

15. The method according to claim 10, further comprising:

pumping the condensate stored in the heat reservoir into the condensate line between the condenser and a condensation pump while loading the heat reservoir with the preheated condensate.

16. A method for operating a steam power plant having a steam generator, a turbine, a condenser, at least one preheater, a feed water container, and a heat reservoir; the method comprising:

connecting the condenser, the at least one preheater and the feed water container with a condensate line;

connecting the heat reservoir parallel to the at least one preheater with a second condensate line;

preheating condensate with the at least one preheater;

reducing the pressure of the condensate streaming out of the condensate line into the heat reservoir prior to loading the heat reservoir; and loading the heat reservoir with the preheated condensate.

17. A steam power plant comprising:

a steam generator;

a turbine that expands steam provided by the steam generator;

a condenser that condenses expanded steam received from the turbine to provide a condensate;

a condensate line that receives the condensate;

a condensate pump disposed downstream of the condenser to pass the condensate through the condensate line;

at least one preheater disposed downstream of the condensate pump to heat the condensate passing through the condensate line;

a feed water container disposed downstream of the at least one preheater to receive the condensate from the at least one preheater via the condensate line; and a heat reservoir having a cold connection and a warm connection and fluidly coupled in parallel to the at least one preheater;

a connecting line fluidly coupling the heat reservoir to the condensate line;

wherein the connecting line includes a first section, a second section and a third section, the first section fluidly coupling the warm connection to the condensate line between the at least one preheater and the feed water reservoir, the second section fluidly coupling the cold connection to the condensate line between the condensate pump and the at least one preheater to provide condensate to the heat reservoir, and the third section fluidly coupling the cold connection to the condensate line upstream of the condensate pump to provide condensate from the heat reservoir to the condensate line;

a first section pump disposed in the first section of the connecting line arranged to provide condensate from the heat reservoir to the condensate line; and a first section bypass line fluidly coupled in parallel to the first section of the connecting line to provide condensate preheated by the at least one preheater to the heat reservoir.

18. The steam power plant according to claim 17, further comprising a first control valve disposed in the first section bypass line and a second control valve in the second section, and a third control valve in the third section.

19. The steam power plant according to claim 17, further comprising a first choke valve disposed in the first section bypass line and a second choke valve in the second section, and a third choke valve in the third section.

20. The steam power plant according to claim 17, wherein the at least one preheater is at least one low pressure preheater.

* * * * *